US006527682B1

(12) United States Patent
Gomez

(10) Patent No.: US 6,527,682 B1
(45) Date of Patent: Mar. 4, 2003

(54) SUPPORT RACK FOR DISC-LIKE WEIGHT MEMBERS

(76) Inventor: Roberto J. Gomez, 1012 Mc Knight Cir., Apt. #2, Rockford, IL (US) 61107

( * ) Notice: Subject to any disclaimer, the term of this patent is extended or adjusted under 35 U.S.C. 154(b) by 326 days.

(21) Appl. No.: 09/595,457

(22) Filed: Jun. 16, 2000

(51) Int. Cl.[7] ..... A63B 21/06

(52) U.S. Cl. ..... 482/98; 482/148; 482/904

(58) Field of Search ..... 482/92–94, 37–40, 482/98, 104, 106–109, 148, 904; 248/200.1, 243; 211/85.5, 103, 193, 87.01

(56) References Cited

U.S. PATENT DOCUMENTS

| | | | | | |
|---|---|---|---|---|---|
| 2,637,555 | A | | 5/1953 | Klaudt | |
| 2,643,170 | A | * | 6/1953 | Vanderveld et al. | 211/193 |
| 2,723,824 | A | * | 11/1955 | Martin | 248/200.1 |
| 2,903,227 | A | | 9/1959 | De Kalb Key | |
| 2,991,040 | A | * | 7/1961 | Levy | 248/200.1 |
| 3,035,708 | A | * | 5/1962 | Freeman | 211/107 |
| 3,080,980 | A | * | 3/1963 | Gibbons | 248/200.1 |
| 3,164,255 | A | * | 1/1965 | Jay | 211/193 |
| 3,207,511 | A | * | 9/1965 | Hoffman | 482/104 |
| 3,642,278 | A | * | 2/1972 | Hinckley | 482/38 |
| 3,828,937 | A | * | 8/1974 | Nash | 248/200.1 |
| 4,047,502 | A | | 9/1977 | Gordon, Jr. | |
| 4,184,415 | A | | 1/1980 | Nicholson | |
| 4,552,270 | A | * | 11/1985 | Lentz et al. | 211/17 |
| 4,729,561 | A | * | 3/1988 | Desjardins | 482/104 |
| 4,730,828 | A | * | 3/1988 | Lane | 482/94 |
| D328,536 | S | | 8/1992 | Ma | |
| 5,318,175 | A | | 6/1994 | Stevens | |
| 5,433,687 | A | * | 7/1995 | Hinzman et al. | 482/104 |
| 5,772,048 | A | * | 6/1998 | Sopcisak | 211/196 |

OTHER PUBLICATIONS

DAX SafetyGym Systems, advertisement in IRONMAN, p. 95, Aug. 1988.*

Ironmaster, advertisement in IRONMAN, p. 186, Apr. 1994.*

* cited by examiner

*Primary Examiner*—Jerome W. Donnelly
*Assistant Examiner*—Victor Hwang

(57) ABSTRACT

A support rack for disc-like weight members for effectively and efficiently storing disc-like weight members. The support rack for disc-like weight members includes an elongate main bracket member having a front wall and a plurality of holes being spaced apart and extending through and along the front wall with the elongate base member being vertically disposed and being adapted to securely mount up against a vertical wall structure; and also includes an elongate secondary bracket member being telescopingly mounted to and extendable from the elongate main bracket member and also being adapted to securely mount to the vertical wall structure and to a ceiling structure; and further includes a plurality of elongate weight support members each being securely disposed in a respective hole of the elongate main bracket member and being extended outwardly therefrom and being adapted to support a plurality of disc-like weight members; and also includes anchor members being threaded through the bracket members and being adapted to securely extend into a structure.

11 Claims, 2 Drawing Sheets

SUPPORT RACK FOR DISC-LIKE WEIGHT MEMBERS

BACKGROUND OF THE INVENTION

1. Field of the Invention

The present invention relates to a weight stacker and more particularly pertains to a new support rack for disc-like weight members for effectively and efficiently storing disc-like weight members.

2. Description of the Prior Art

The use of a weight stacker is known in the prior art. More specifically, a weight stacker heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,184,415; 5,318,175; U.S. Patent No. Des. 328,536; U.S. Pat. Nos. 2,637,555; 4,047,502; and 2,903,227.

While these devices fulfill their respective, particular objectives and requirements, the aforementioned patents do not disclose a new support rack for disc-like weight members. The inventive device includes an elongate main bracket member having a front wall and a plurality of holes being spaced apart and extending through and along the front wall with the elongate base member being vertically disposed and being adapted to securely mount up against a vertical wall structure; and also includes an elongate secondary bracket member being telescopingly mounted to and extendable from the elongate main bracket member and also being adapted to securely mount to the vertical wall structure and to a ceiling structure; and further includes a plurality of elongate weight support members each being securely disposed in a respective hole of the elongate main bracket member and being extended outwardly therefrom and being adapted to support a plurality of disc-like weight members; and also includes anchor members being threaded through the bracket members and being adapted to securely extend into a structure.

In these respects, the support rack for disc-like weight members according to the present invention substantially departs from the conventional concepts and designs of the prior art, and in so doing provides an apparatus primarily developed for the purpose of effectively and efficiently storing disc-like weight members.

SUMMARY OF THE INVENTION

In view of the foregoing disadvantages inherent in the known types of weight stacker now present in the prior art, the present invention provides a new support rack for disc-like weight members construction wherein the same can be utilized for effectively and efficiently storing disc-like weight members.

The general purpose of the present invention, which will be described subsequently in greater detail, is to provide a new support rack for disc-like weight members which has many of the advantages of the weight stacker mentioned heretofore and many novel features that result in a new support rack for disc-like weight members which is not anticipated, rendered obvious, suggested, or even implied by any of the prior art weight stacker, either alone or in any combination thereof.

To attain this, the present invention generally comprises an elongate main bracket member having a front wall and a plurality of holes being spaced apart and extending through and along the front wall with the elongate base member being vertically disposed and being adapted to securely mount up against a vertical wall structure; and also includes an elongate secondary bracket member being telescopingly mounted to and extendable from the elongate main bracket member and also being adapted to securely mount to the vertical wall structure and to a ceiling structure; and further includes a plurality of elongate weight support members each being securely disposed in a respective hole of the elongate main bracket member and being extended outwardly therefrom and being adapted to support a plurality of disc-like weight members; and also includes anchor members being threaded through the bracket members and being adapted to securely extend into a structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new support rack for disc-like weight members which has many of the advantages of the weight stacker mentioned heretofore and many novel features that result in a new support rack for disc-like weight members which is not anticipated, rendered obvious, suggested, or even implied by any of the prior art weight stacker, either alone or in any combination thereof.

It is another object of the present invention to provide a new support rack for disc-like weight members which may be easily and efficiently manufactured and marketed.

It is a further object of the present invention to provide a new support rack for disc-like weight members which is of a durable and reliable construction.

An even further object of the present invention is to provide a new support rack for disc-like weight members which is susceptible of a low cost of manufacture with regard to both materials and labor, and which accordingly is then susceptible of low prices of sale to the consuming public, thereby making such support rack for disc-like weight members economically available to the buying public.

Still yet another object of the present invention is to provide a new support rack for disc-like weight members which provides in the apparatuses and methods of the prior art some of the advantages thereof, while simultaneously overcoming some of the disadvantages normally associated therewith.

Still another object of the present invention is to provide a new support rack for disc-like weight members for effectively and efficiently storing disc-like weight members.

Yet another object of the present invention is to provide a new support rack for disc-like weight members which includes an elongate main bracket member having a front wall and a plurality of holes being spaced apart and extending through and along the front wall with the elongate base member being vertically disposed and being adapted to securely mount up against a vertical wall structure; and also includes an elongate secondary bracket member being telescopingly mounted to and extendable from the elongate main bracket member and also being adapted to securely mount to the vertical wall structure and to a ceiling structure; and further includes a plurality of elongate weight support members each being securely disposed in a respective hole of the elongate main bracket member and being extended outwardly therefrom and being adapted to support a plurality of disc-like weight members; and also includes anchor members being threaded through the bracket members and being adapted to securely extend into a structure.

Still yet another object of the present invention is to provide a new support rack for disc-like weight members that neatly arranges the weight members essentially out of the way of a person using other aspects of the floor space.

Even still another object of the present invention is to provide a new support rack for disc-like weight members that essentially utilizes the walls within a particular room.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration. is given to the following detailed description thereof. Such description makes reference to the annexed drawings wherein.

DESCRIPTION OF THE PREFERRED EMBODIMENT

Figures 1, 2:
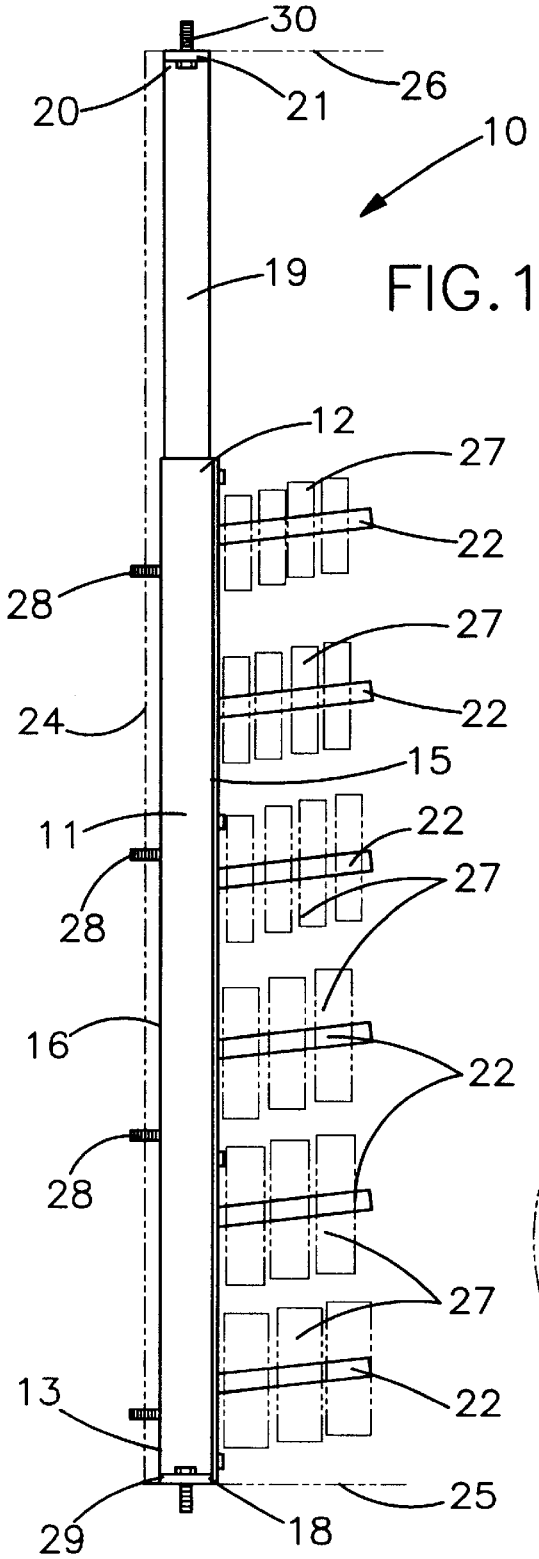
FIG. 1 is a side elevational view of a new support rack for disc-like weight members according to the present invention.
FIG. 2 is a detailed partial front elevational view of the main bracket member of the present invention.
Figure 3:
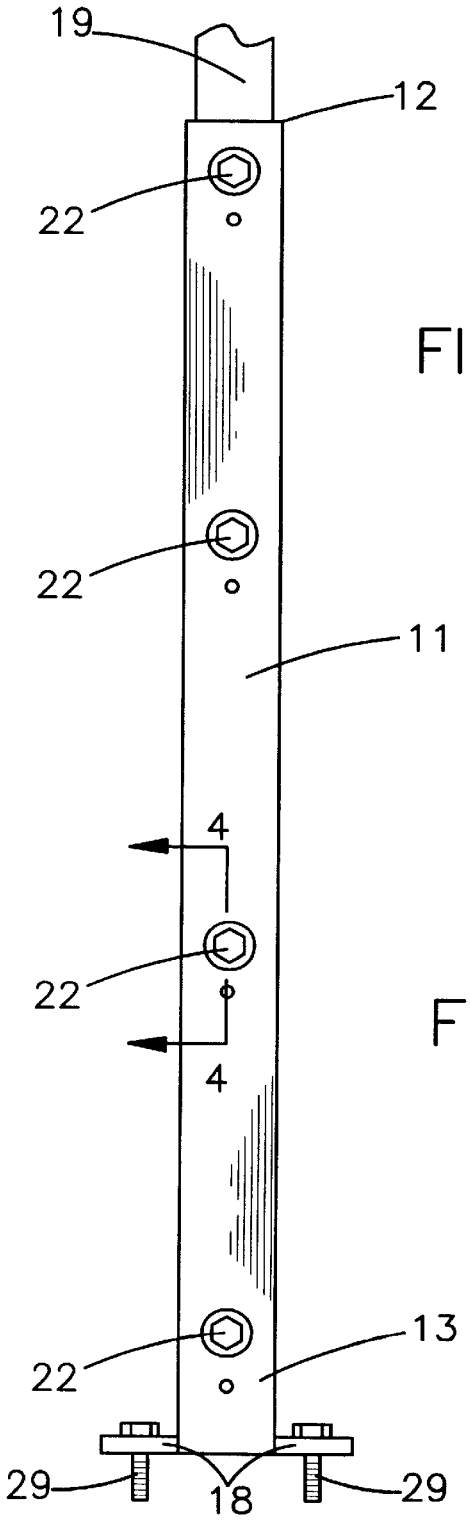
FIG. 3 is a front elevational view of the present invention.
Figure 4:
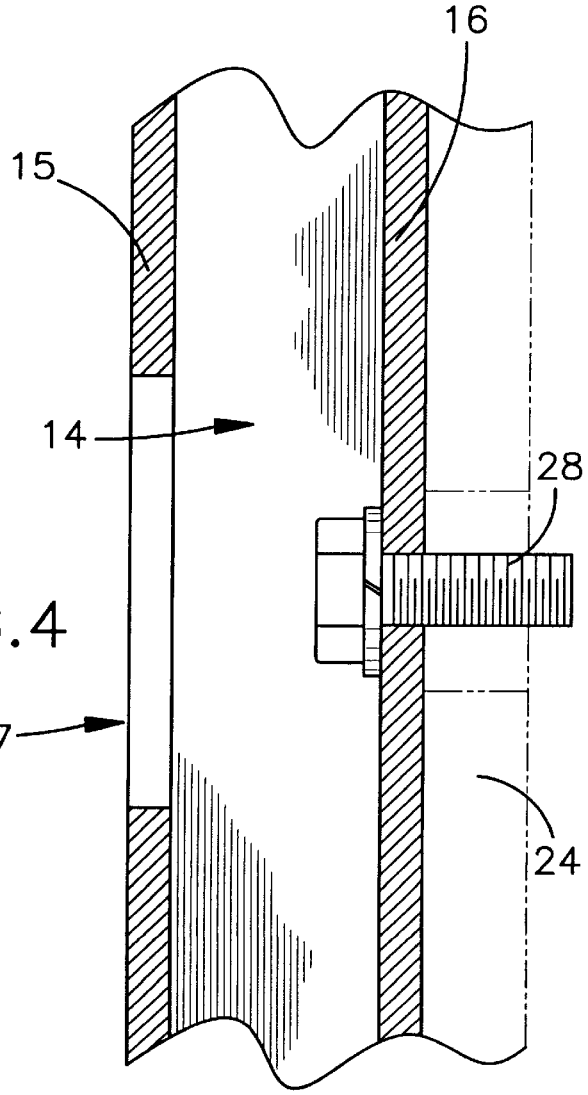
FIG. 4 is a detailed partial cross-sectional view of the present invention.

With reference now to the drawings, and in particular to FIGS. 1 through 4 thereof, a new support rack for disc-like weight members embodying the principles and concepts of the present invention and generally designated by the reference numeral 10 will be described.

As best illustrated in FIGS. 1 through 4, the support rack for disc-like weight members 10 generally comprises an elongate main bracket member 11 having a front wall 15 and a plurality of holes 17 being spaced apart and extending through and along the front wall 15. The elongate base member 11 is vertically disposed and being adapted to securely mount up against a vertical wall structure 24 with the elongate main bracket member 11 including a tubular member having an open top end 12, a bottom end 13, and a bore 14 extending therein. The bottom end 13 of the tubular member 11 includes first tab-like mounting members 18 securely and conventionally attached thereto for securely mounting the bottom end 13 of the tubular member 11 to a floor structure 25. The tubular member 11 essentially has a square cross-section and has a thickness of approximately 1½ inches.

An elongate secondary bracket member 19 is telescopingly mounted to and extendable from the elongate main bracket member 11 and also is adapted to securely mount to a vertical wall structure 24 and to a ceiling structure 26. The elongate secondary bracket member 19 is movably disposed in and securely extendable from the elongate main bracket member 11 through the open top end 12 thereof with the elongate secondary bracket member 19 including a top end 20 and second tab-like mounting members 21 being securely and conventionally attached at the top end 20 thereof for mounting to the ceiling structure 26.

The support rack 10 also includes a plurality of elongate weight support members 22 each being securely and conventionally disposed in a respective hole 17 of the elongate main bracket member 11 and being extended outwardly therefrom and being adapted to support a plurality of disc-like weight members 27. Each of the elongate support members 22 is angled relative to the elongate main bracket member 11 with the elongate support members 22 being adapted to be angled upwardly relative to the floor structure 25. Each of the elongate support members 22 is adapted to be angled upwardly at approximately 5 degrees relative to the floor structure 25 with each of the elongate support members 22 having a length of approximately 8 inches and a diameter of approximately ¾ inches.

Anchor members 28–30 are threaded through the bracket members 11,19 and are adapted to securely extend into a structure 24–26. The anchor members 28–30 include first anchor members 28 which are threaded through a back wall 16 of the elongate main bracket member 11, and also include second anchor members 29 which are threaded through the first tab-like mounting members 18, and also include third anchor members 30 which are threaded through the second tab-like mounting members 21.

In use, the user slides the disc-like weight members 27 upon the elongate support members 22 to essentially save floor space. When needed, the user can simply slide one or more of the disc-like weight members 27 off the elongate support members 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A support rack for disc-like weight members comprising an elongate main bracket member for mounting on a floor structure, said elongate main bracket member having a front wall, said elongate main bracket member having an open top end extending into an interior of said elongate main bracket member;

an elongate secondary bracket member for mounting to a ceiling structure, said elongate secondary bracket member being telescopingly received in the interior of said elongate main bracket member and being extendable out of the open top end of said elongate main bracket member for adjusting an overall length of said bracket members to correspond to a distance between the floor structure and the ceiling structure;

a plurality of elongate weight support member for supporting disc-like weight members, each of said weight support members being mounted on said elongate main bracket member and being extended outwardly therefrom;

at least one first tab mounting member mounted on and extending from a bottom end of said elongate main bracket member for abutting against and attaching to the floor structure;

at least one second tab mounting members mounted on and extending from a top end of said elongate secondary bracket member for abutting against and attaching to the ceiling structure; and anchor members for extending into a structure, said anchor members being threaded through said bracket members.

2. A support rack for disc-like weight members as described in claim 1, additionally comprising a plurality of holes being spaced apart and extending through and along said front wall for receiving anchor members extending into a vertical wall structure when said elongate main bracket member is positioned adjacent to the vertical wall structure.

3. A support rack for disc-like weight members as described in claim 1, wherein said at least one first tab mounting member extends substantially perpendicular to a longitudinal axis of said elongate main bracket member for positioning adjacent to the floor structure.

4. A support rack for disc-like weight members as described in claim 1, wherein each of said tab mounting members has a hole formed therein for receiving an anchor member therethrough.

5. A support rack for disc-like weight members as described in claim 1, wherein said at least one second tab mounting member extends substantially perpendicular to a longitudinal axis of said elongate secondary bracket member for positioning adjacent to the ceiling structure.

6. A support rack for disc-like weight members as described in claim 1, wherein each of said elongate support members is angled relative to said elongate main bracket member.

7. A support rack for disc-like weight members as described in claim 1, wherein said elongate support members are angled upwardly at approximately 5 degrees relative to an axis extending perpendicular to a longitudinal axis of said elongate main bracket member.

8. A support rack for disc-like weight members as described in claim 1, wherein each of said elongate support members has a length of approximately 8 inches and a diameter of approximately ¾ inches.

9. A support rack for disc-like weight members as described in claim 1, additionally comprising:

a plurality of holes being spaced apart and extending through and along said front wall for receiving anchor members extending into a vertical wall structure when said elongate main bracket member is positioned adjacent to the vertical wall structure;

wherein said at least one first tab mounting member extends substantially perpendicular to a longitudinal axis of said elongate main bracket member for positioning adjacent to the floor structure;

wherein each of said tab mounting members has a hole formed therein for receiving an anchor member therethrough;

wherein said at least one second tab mounting member extends substantially perpendicular to a longitudinal axis of said elongate secondary bracket member for positioning adjacent to the ceiling structure;

wherein each of said elongate support members is angled relative to said elongate main bracket member; and wherein said elongate support members are angled upwardly at approximately 5 degrees relative to an axis extending perpendicular to a longitudinal axis of said elongate main bracket member.

10. A support rack for disc-like weight members comprising an elongate main bracket member for mounting against a vertical wall structure, said main bracket member having a front wall and a plurality of holes being spaced apart and extending through and along said front wall;

an elongate secondary bracket member for mounting against a vertical wall structure and to a ceiling structure, said secondary bracket member being telescopingly mounted to and extendable from said elongate main bracket member;

a plurality of elongate weight support members for supporting disc-like weight members, each of said weight support members being securely disposed in a respective said hole of said elongate main bracket member and being extended outwardly therefrom;

anchor members for extending into a structure, said anchor members being threaded through said bracket members;

wherein said elongate main bracket member includes a tubular member having an open top end, a bottom end, and a bore extending therein;

wherein said bottom end of said tubular member includes first tab-like mounting members securely attached thereto for securely mounting said bottom end of said tubular member to a floor structure;

wherein said elongate secondary bracket member is movably disposed in and extendable from said elongate main bracket member through said open top end thereof;

wherein said elongate secondary bracket member includes a top end and second tab-like mounting members securely attached at said top end thereof for mounting to the ceiling structure;

wherein each of said elongate support members is angled relative to said elongate main bracket member;

wherein said elongate support members are angled upwardly at approximately 5 degrees relative to an axis extending perpendicular to a longitudinal axis of said elongate main bracket member;

wherein each of said elongate support members has a length of approximately 8 inches and a diameter of approximately ¾ inches; and wherein said anchor members include first anchor members which are threaded through a back wall of said elongate main bracket member, and also include second anchor members which are threaded through said first tab-like mounting members, and also include third anchor members which are threaded through said second tab-like mounting members.

11. A support rack for disc-like weight members comprising an elongate main bracket member for mounting against a vertical wall structure, said main bracket member having a front wall and a plurality of holes being spaced apart and extending through and along said front wall, said elongate base member being vertically disposed, said elongate main bracket member including a tubular member having an open top end, a bottom end, and a bore extending therein, said bottom end of said tubular member including first tab-like mounting members securely attached thereto for securely mounting said bottom end of said tubular member to a floor structure, said tubular member essentially having a square cross-section and having a depth of approximately 1½ inches;

an elongate secondary bracket member for mounting against a vertical wall structure a ceiling structure, said secondary bracket member being telescopingly mounted to and extendable from said elongate main bracket member, said elongate secondary bracket member being movably disposed in and extendable from said elongate main bracket member through said open top end thereof, said elongate secondary bracket member including a top end and second tab-like mounting members being securely attached at said top end thereof for mounting to the ceiling structure;

a plurality of elongate weight support members for supporting disc-like weight members, each of said weight support members being securely disposed in a respective said hole of said elongate main bracket member and being extended outwardly therefrom and being adapted to support a plurality of disc-like weight members, each of said elongate support members is angled relative to said elongate main bracket member, said elongate support members being angled upwardly at approximately 5 degrees relative to an axis extending perpendicular to a longitudinal axis of said elongate main bracket member, each of said elongate support members having a length of approximately 8 inches and a diameter of approximately ¾ inches; and anchor members for extending into a structure, said anchor members being threaded through said bracket members, said anchor members including first anchor members which are threaded through a back wall of said elongate main bracket member, and also including second anchor members which are threaded through said first tab-like mounting members, and also including third anchor members which are threaded through said second tab-like mounting members.

* * * * *